US007191931B2

(12) United States Patent
Damkjaer

(10) Patent No.: US 7,191,931 B2
(45) Date of Patent: Mar. 20, 2007

(54) OPENING ARRANGEMENT, PACKAGING AND METHOD OF PROVIDING A PACKAGING WITH AN OPENING ARRANGEMENT

(75) Inventor: Niels Damkjaer, Kävlinge (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/382,661

(22) Filed: Mar. 7, 2003

(65) Prior Publication Data

US 2005/0101466 A1 May 12, 2005

(30) Foreign Application Priority Data

Dec. 6, 2002 (SE) ..... 0203617

(51) Int. Cl.
*B65D 43/00* (2006.01)
*B65D 43/16* (2006.01)

(52) U.S. Cl. ..... 229/102; 220/269; 220/270; 220/359.2; 229/125.14; 229/125.15

(58) Field of Classification Search ..... 229/102, 229/125.04, 125.09, 125.14, 125.15; 220/268, 220/269, 270, 276, 359.2
See application file for complete search history.

(56) References Cited

U.S. PATENT DOCUMENTS

| | | | | |
|---|---|---|---|---|
| 3,301,458 | A | | 1/1967 | Rausing et al. |
| 3,604,596 | A | * | 9/1971 | Khoury et al. ..... 220/266 |
| 3,650,458 | A | | 3/1972 | Rausing |
| 3,658,238 | A | | 4/1972 | Nedstedt |
| 3,883,034 | A | | 5/1975 | Rausing |
| 3,900,155 | A | | 8/1975 | Rausing et al. |
| 3,977,591 | A | | 8/1976 | Mårtensson et al. |
| 4,101,051 | A | | 7/1978 | Reil |
| 4,113,103 | A | | 9/1978 | Carlsson |
| 4,126,263 | A | | 11/1978 | Mårtensson |
| 4,197,949 | A | | 4/1980 | Carlsson |

(Continued)

FOREIGN PATENT DOCUMENTS

DE 19544601 A1 6/1997

(Continued)

OTHER PUBLICATIONS

Patent Abstracts of Japan, vol. 200, No. 211, Nov. 6, 2002 and JP 2002193250 A, Nippon Tetra Pak KK, Jul. 10, 2002.

(Continued)

*Primary Examiner*—Gary E. Elkins
(74) *Attorney, Agent, or Firm*—Buchanan Ingersoll & Rooney PC

(57) ABSTRACT

An opening arrangement includes a bottom piece disposed to be positioned on a packaging material and to define a pouring opening; a lid disposed, in a closed state, to seal the pouring opening; and a tamper evidence intended to be broken the first time the opening arrangement is opened and which is connected to a pull tab connected to the lid and to a fastening surface disposed to be connected to the packaging material. The fastening surface is disposed to extend over a fold line along which the packaging material is intended to be folded for forming a package. A package and a method of providing a package with an opening arrangement are also disclosed.

15 Claims, 6 Drawing Sheets

U.S. PATENT DOCUMENTS

| | | | | | |
|---|---|---|---|---|---|
| 4,223,789 | A | * | 9/1980 | Reil | 229/125.15 |
| 4,258,876 | A | | 3/1981 | Ljungcrantz | |
| 4,312,450 | A | | 1/1982 | Reil | |
| 4,585,498 | A | | 4/1986 | Lagerstedt et al. | |
| 4,715,528 | A | * | 12/1987 | Kjelgaard et al. | 220/359.2 |
| 4,725,213 | A | | 2/1988 | Reil et al. | |
| 4,730,769 | A | | 3/1988 | Stark | |
| 4,770,325 | A | | 9/1988 | Gordon et al. | |
| 4,815,655 | A | | 3/1989 | Jacobsson et al. | |
| 4,819,839 | A | | 4/1989 | Carlsson et al. | |
| 4,986,465 | A | * | 1/1991 | Jacobsson et al. | 220/269 |
| 5,067,614 | A | * | 11/1991 | Jonsson | 229/125.09 |
| 5,098,365 | A | | 3/1992 | Lilja | |
| 5,108,029 | A | * | 4/1992 | Abrams et al. | 229/125.09 |
| 5,364,019 | A | | 11/1994 | Björck et al. | |
| 5,484,101 | A | | 1/1996 | Hedberg | |
| 5,495,706 | A | | 3/1996 | Björck et al. | |
| 5,772,060 | A | | 6/1998 | Kaneko et al. | |
| 5,884,837 | A | | 3/1999 | Jacobsson et al. | |
| 6,003,713 | A | | 12/1999 | Derving | |
| 6,079,618 | A | | 6/2000 | Hedberg et al. | |
| 6,102,236 | A | | 8/2000 | Ohlsson et al. | |
| 6,302,289 | B1 | | 10/2001 | Andersson et al. | |
| 6,303,066 | B1 | | 10/2001 | Gustafsson et al. | |
| 6,454,161 | B1 | | 9/2002 | Rendina et al. | |
| 2002/0148201 | A1 | | 10/2002 | Lees et al. | |

FOREIGN PATENT DOCUMENTS

| | | | | | |
|---|---|---|---|---|---|
| EP | 0 444 862 | B2 | | 9/1991 | |
| EP | 1 160 172 | A1 | | 5/2001 | |
| JP | 5/51032 | A | * | 3/1993 | 229/125.09 |
| WO | 0 244 040 | A1 | | 6/2002 | |

OTHER PUBLICATIONS

Database WPI, Derwent Publications Ltd., London GB, & JP 11334753 A, Nippon Tetrapak KK, Dec. 7, 1999.

* cited by examiner

OPENING ARRANGEMENT, PACKAGING AND METHOD OF PROVIDING A PACKAGING WITH AN OPENING ARRANGEMENT

FIELD OF THE INVENTION

The present invention relates to an opening arrangement comprising a bottom piece which is arranged so as to be positioned on a packaging material and to delimit a pouring opening, a lid which is arranged so as, in closed position, to seal the pouring opening, tamper evidence which is intended to be broken the first time the opening arrangement is opened and which is connected to on the one hand a pull tab connected to the lid and on the other hand a fastening surface which is arranged so as to be connected to the packaging material.

The present invention also relates to a packaging produced by folding a packaging material, which is provided with an opening arrangement which comprises a bottom piece which is intended to define a pouring opening, a lid which is arranged so as, in closed position, to seal the pouring opening, tamper evidence which is intended to be broken the first time the opening arrangement is opened and which is connected to on the one hand the lid and on the other hand a fastening surface which is connected to the packaging material.

The present invention relates moreover to a method of providing a packaging with an opening arrangement.

BACKGROUND OF THE INVENTION

There are a great many ways of shaping, folding and welding together plastic-film-coated paper material in order to produce packagings for liquid foodstuffs such as milk, juices and the like.

A commercially common method of producing a foodstuff packaging and filling it with a liquid foodstuff is shown in principle in FIG. 1. A paper web 1 is shaped continuously into a tube by the two longitudinal edges 1*a–b* of the paper web being welded together, and the foodstuff in question is then filled into the newly formed tube. In the next process step, the tube is divided into packagings by being transversely sealed and cut along the transverse seal so that pillow-shaped packaging blanks are formed, which are given their final shape by the corners being folded in and fastened to the side surfaces of the packaging. A commercially well-known example of a packaging which is shaped in this way is the cuboid Tetra Brik (registered trademark) packaging produced by Tetra Pak.

The packaging material comprises at least one layer of paper and at least one layer of plastic. The plastic layer provides the paper layer with the necessary resistance to wet and is moreover intended to be partly melted in order to weld different portions of the packaging material together.

Recently, this type of packaging has been provided with various types of opening arrangement.

For example, U.S. Pat. No. 4,725,213 discloses an opening arrangement made of plastic which has been injection-moulded directly in place on a packaging material. A pair of mould halves is moved into engagement around a punched-out hole in the packaging material, and a heated thermoplastic material is injected into the mould cavity and thus forms an opening arrangement which covers the hole punched in the packaging material. The mould halves are shaped so that the injection-moulded opening arrangement comprises two flanges which extend around the periphery of the hole and lie against opposite sides of the packaging material around the edge of the punched-out hole, the opening arrangement gripping around the edge of the hole and in this way sealing against the packaging material.

U.S. Pat. No. 6,454,161 discloses another variant of such an opening arrangement. This opening arrangement has moreover been provided with tamper evidence which indicates to the consumer whether or not the packaging has been opened previously. In the design disclosed, however, problems may arise in some cases in connection with distribution because the opening arrangement disclosed extends up from the top side of the packaging. When a number of packagings are stacked on top of one another, there is a risk that the tamper evidence will be compressed and damaged, so that it is no longer unbroken even though the packaging has not been opened. If, to solve this problem, attempts are made to make the tamper evidence stronger, however, the problem arises that it is difficult for the consumer to open the packaging the first time when the tamper evidence has to be broken.

A further problem which should be mentioned in the context is that some configurations of opening arrangement suffer from the problem that the fastening surface to which the tamper evidence is fastened tends to come loose if it is subjected to great loads during distribution or when a consumer intends to open the packaging for the first time.

SUMMARY OF THE INVENTION

One object of the invention is therefore to produce an opening arrangement with tamper evidence.

Another object of the invention is to produce an opening arrangement which is adapted in such a way that, if so desired, it can be injection-moulded directly over a hole in a packaging material.

A further object of the invention is to produce an opening arrangement which is provided with a fastening surface which withstands great loads without coming loose.

According to the invention, the abovementioned objects have been achieved by means of an opening arrangement of the type described in the introduction which has been provided with the characteristic that the fastening surface is arranged so as to extend over a fold line along which the packaging material is intended to be folded for formation of a packaging. In this way, the fastening surface will have to be pulled around the corner in order for it to be possible for it to be torn away, which means that, purely geometrically, it is more difficult to pull the fastening surface loose from the packaging. Moreover, the conventional packaging material consisting of paper laminate is used in a better way. A paper-based packaging laminate usually has greater resistance to delamination in connection with shearing between the layers compared with pulling-apart of the layers in the normal direction.

Preferred embodiments of the invention emerge from the dependent patent claims.

According to a preferred embodiment, that portion of the fastening surface which is intended to be located on the same side of the fold line as the bottom piece has a thickness which is greater than the thickness of that portion of the fastening surface which is intended to be located on the other side of the fold line. In this way, it is possible to produce a stable fastening surface which provides stability to the connection to the tamper evidence. Moreover, the thinner part is easier to fold in connection with the packaging being folded. In connection with injection-moulding an opening arrangement of this type, the narrowing between the thicker portion and the thinner portion also means that frictional heat is generated which contributes to ensuring that the whole mould cavity is filled.

Advantageously, the opening arrangement is manufactured in one piece, preferably by injection-moulding a polymer, such as a thermoplastic material. In this way, it is possible in a cost-effective way to produce an opening arrangement with a number of functional features. It is moreover possible to use the technique for the great majority of different types of packaging system.

According to a preferred embodiment, the lid and the bottom piece are moulded in a closed state, the connection between the lid and the bottom piece around the greater part of the pouring opening comprising a weakening line which is intended to be broken the first time the opening arrangement is opened. In this way, an opening arrangement is produced which is tight directly after moulding and which, after the first opening, can be reclosed, for example by that portion of the lid which carries the weakening surface being pressed down into the pouring opening.

Advantageously, the opening arrangement is manufactured in one piece, preferably by injection-moulding a polymer, such as a thermoplastic material, directly on the packaging material. In this way, it is possible relatively simply to provide packagings from a continuous web-fed system as mentioned above with opening arrangements. Preferably, holes are punched, and the opening arrangement is moulded directly over the hole in the filling machine.

The abovementioned objects have also been achieved by means of a packaging of the type indicated in the introduction which has been provided with the characterizing features that the fastening surface extends over a fold line along which the packaging material is folded for formation of a packaging. As discussed in detail above, this affords a number of advantages as far as the strength of the packaging is concerned. The fastening surface will have to be pulled around the corner in order for it to be possible for it to be torn away, which means that, purely geometrically, it is more difficult to pull the fastening surface loose from the packaging. Moreover, the conventional packaging material consisting of paper laminate is used in a better way. A paper-based packaging laminate usually has greater resistance to delamination in connection with shearing between the layers compared with pulling-apart of the layers in the normal direction.

Preferred embodiments of the invention emerge from the dependent patent claims. Advantages with regard to these features emerge from the explanations above with regard to corresponding features in connection with the opening arrangement.

The abovementioned objects have also been achieved according to the invention by means of a method of providing a packaging with an opening arrangement, comprising the steps of producing an opening arrangement which comprises a bottom piece, a lid hinged about a folding joint, tamper evidence which is intended to be broken the first time the opening arrangement is opened and which is connected to on the one hand the lid and on the other hand a fastening surface, securing the opening arrangement on a packaging material, and securing the fastening surface so that it extends over a fold line along which the packaging material is intended to be folded for formation of a packaging.

As discussed in detail above, this affords a number of advantages as far as the strength of the packaging is concerned. The fastening surface will have to be pulled around the corner in order for it to be possible for it to be torn away, which means that, purely geometrically, it is more difficult to pull the fastening surface loose from the packaging. Moreover, the conventional packaging material consisting of paper laminate is used in a better way. A paper-based packaging laminate usually has greater resistance to delamination in connection with shearing between the layers compared with pulling-apart of the layers in the normal direction.

Preferred embodiments of the invention emerge from the dependent patent claims.

According to a preferred embodiment, the folding of the packaging material is carried out so that the fastening surface is folded double. This reinforces the mechanical strength of the fastening of the fastening surface. Folding double also means that the fastening surface has to come away from the packaging material in a direction which is opposite to the pulling direction on the outermost edge of the fastening surface.

Advantageously, the said method comprises the steps of punching a hole in a packaging material and securing the opening arrangement over the hole. In this way, a packaging can be produced which is easy to open and in many cases can also be reclosed.

According to a preferred embodiment, the said method also comprises the steps of closing a mould space around the hole in the packaging material by means of a moulding tool, injection-moulding in one piece an opening arrangement comprising a bottom piece, a folding lid, a grip tab, tamper evidence and a fastening surface, and, during injection-moulding, securing the bottom piece and the fastening surface to the packaging material. In this way, it is possible to provide packagings with opening arrangements virtually irrespective of which system is used for shaping and filling the packagings. The technique can be used for what are known as roll-fed systems and for what are known as blank-fed systems.

According to a preferred embodiment, the said method also comprises the step of folding the packaging material for formation of a packaging along a line which extends transversely to a line which is defined by the grip tab, the tamper evidence and the fastening surface. The packaging with opening arrangement produced in this way is designed so that the consumer breaks the tamper evidence by applying a force in a transverse direction in relation to the direction in which the grip tab, the tamper evidence and the fastening surface extend. In this way, the possibility has been created therewith of separating the direction in which the tamper evidence is loaded during manufacture and distribution in relation to the direction in which it is loaded when the consumer opens the packaging for the first time. This means that it is possible to design the tamper evidence so that it is strong as far as distribution loads are concerned, but it is at the same time possible to provide it with a clear tear indication which makes opening easier for the consumer. By folding the opening arrangement and the packaging, the tamper evidence is in a certain sense being hidden from the forces which could otherwise cause it to break when several layers of packagings are stacked on top of one another. It is moreover easier for a consumer to grip the packaging and pull away the tamper evidence in a natural way. A consumer usually grips the packaging around the upright rear side of the packaging with the opening arrangement at the top of the packaging. As the tamper evidence extends around the corner edge and down onto the narrow front side, it is easy to take hold of the tamper evidence with the free hand without having to angle the packaging or the free hand at a strange angle. Moreover, the natural gripping direction will mean that the consumer (even if s/he has not understood correctly in which direction the tamper evidence is to be torn) applies a force with a certain component in the transverse direction, which ensures that correct tearing-off of the tamper evidence will take place.

In order to facilitate folding, it is advantageous to provide the packaging material with a crease line, the bottom surface and the fastening surface being secured on either side of the crease line.

According to a preferred embodiment, the packaging material is web-shaped when the injection-moulding of the opening arrangement takes place on the packaging material, which makes it easier to reach the material from both sides.

Advantageously, the grip tab and the tamper evidence form a curve after injection-moulding on the packaging material, which curve extends between the lid and the fastening surface, which makes it easier for the grip tab and the tamper evidence to be folded in connection with the folding of the packaging.

BRIEF DESCRIPTION OF THE DRAWINGS

The invention will be described in greater detail below with reference to the accompanying diagrammatic drawings which, for the purpose of exemplification, show a for the present preferred embodiment of the invention.

DETAILED DESCRIPTION OF THE INVENTION

Figure 1:
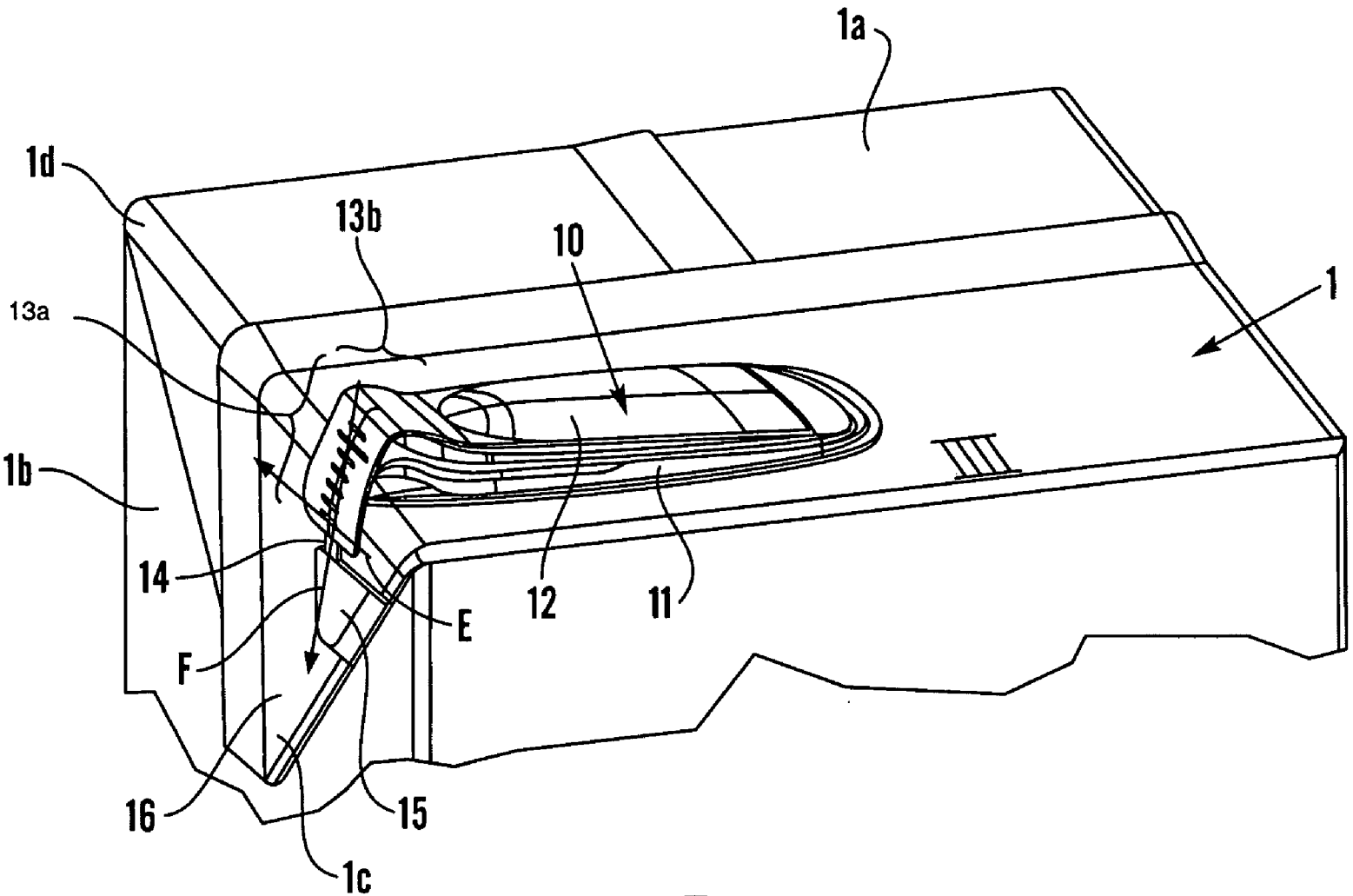
FIG. 1 shows in perspective an upper portion of a cuboid packaging provided with an opening arrangement.
Figure 2:
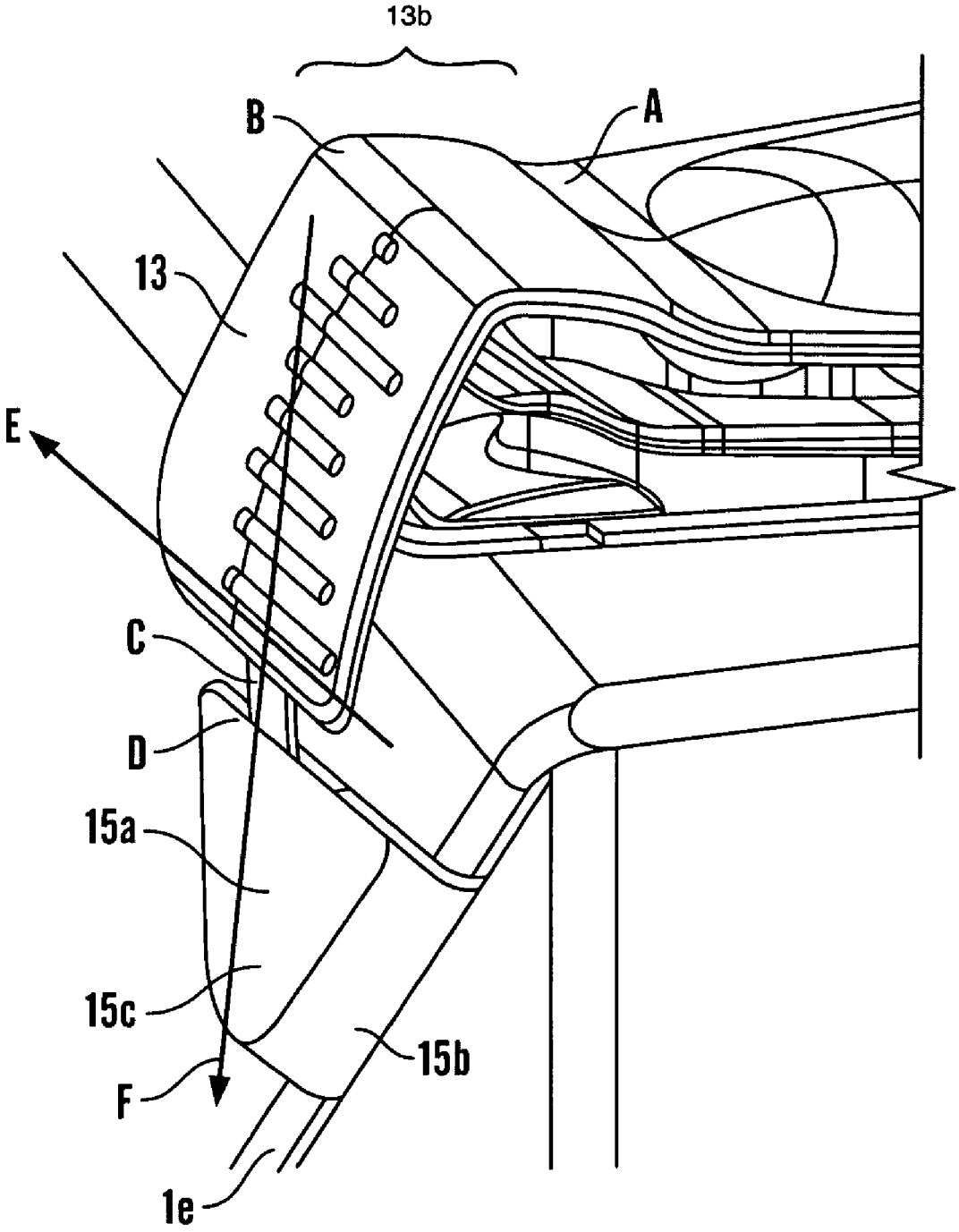
FIG. 2 shows an enlargement of part of FIG. 1.

FIGS. 1 and 2 show a packaging 1 which is provided with an opening arrangement 10. This opening arrangement 10 comprises a bottom piece 11 which is secured around a hole in the packaging material, a lid 12 which, in closed position, covers the hole in the packaging material and the bottom piece 11, and a grip tab 13 which is connected by one of its ends to the lid 12 and by means of which a consumer can open and close the lid 12. At its other end, the grip tab 13 is connected to a tamper evidence seal 14 which is in turn connected to a fastening surface 15. This fastening surface 15 is secured on the packaging material.

The bottom piece 11 is secured on the top surface 1*a* of the packaging 1, and the fastening surface is secured on a side surface 1*b* of the packaging. In the embodiment shown in FIG. 1, the packaging is designed so that the top surface 1*a* and the side surface 1*b* form a right angle in relation to one another. The invention can of course be applied to other types of packaging, such as, for example, what may be described as roofridge packagings and the like. In such cases, the bottom piece is suitably secured on one of the roof surfaces extending obliquely upwards, and the fastening surface is secured on one of the side surfaces directly below the transition between the roof surface and the side surface. For a conventional roof-ridge packaging, the roof surface and the fastening surface form an angle of approximately 120°. There are also different variants of packaging with inclined top surfaces where the present invention can be applied. The angle between the top surface and the side surface for such packagings can vary between, for example, just below 90° to nearly or just over 135°. In the case of 135° between the side surface and the top surface, the top surface forms an angle of 45° with the horizontal plane if the packaging is conventionally designed with a side surface which is at right angles to the bottom surface. Recently, packagings have also appeared in which one or more of the side surfaces is or are inclined in relation to the bottom surface. In cases where the side surface slopes outwards from the packaging, the abovementioned angles are slightly smaller corresponding to the degree to which the side surface slopes, and if the side surface slopes inwards towards the interior of the packaging, the abovementioned angles are slightly greater corresponding to the degree to which the side surface slopes. Above all, packagings which are provided with side surfaces sloping outwards and horizontal or almost horizontal top surfaces should be considered. In such cases, the right angle is converted into an angle which is slightly smaller, in the order of roughly 70–80° or nearly 90° according to the slope of the side surface. For packagings with side surfaces sloping outwards and inclined top surfaces, it is likely that the packaging is shaped so that the angle between the surfaces is virtually perpendicular.

As can be seen from FIG. 1, a first portion 13*a* of the grip tab 13, to which the tamper evidence 14 is connected, the tamper evidence 14 and the fastening surface 15 extend along a common geometrical plane 16 which is parallel to the side surface 1*b* of the packaging 1 and adjacent to the corner flap 1*c* folded against the side surface 1*b*. For a roof-ridge packaging, this corner flap 1*c* is not usually present, but the grip tab 13, the tamper evidence 14 and the fastening surface 15 extend directly along the side surface (not shown). The grip tab 13 also has a second portion 13*b*, via which the grip tab 13 is connected to the lid 12. The two portions 13*a–b* form an angle in relation to one another which is of the same order as the angle between the top surface 1*a* and the side surface 1*b*. Furthermore, the angle between the two portions 13*a*, 13*b* lies just outside the corner edge 1*d* between the top surface 1*a* and the side surface 1*c* and constitutes an essential part of the bending of the opening arrangement 10 which is necessary in order for it to be possible for its bottom piece 11 and fastening surface 15 to be connected to two surfaces 1*a*, 1*b* which are angled in relation to one another.

Figure 4:
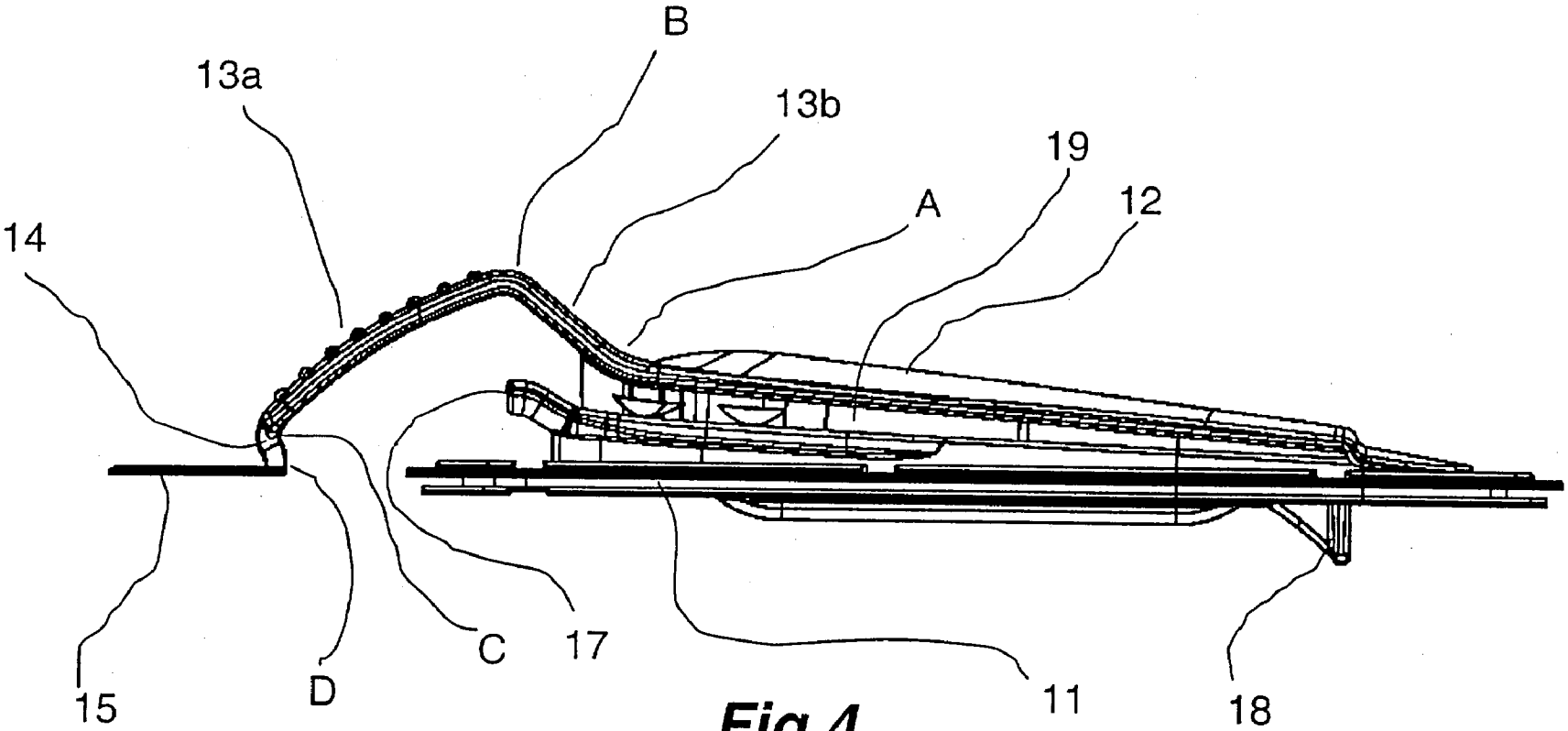
FIG. 4 shows an opening arrangement seen from the side.

As can be seen from FIG. 4, the opening arrangement 10 also has a pouring edge 17 in order to facilitate pouring-out of the product filled into the packaging. FIG. 4 also shows two legs 18 which are intended to lie against the top edge of the pouring opening and hold the lid 12 in the open state. These components can be designed in a great many different ways.

Figure 3:
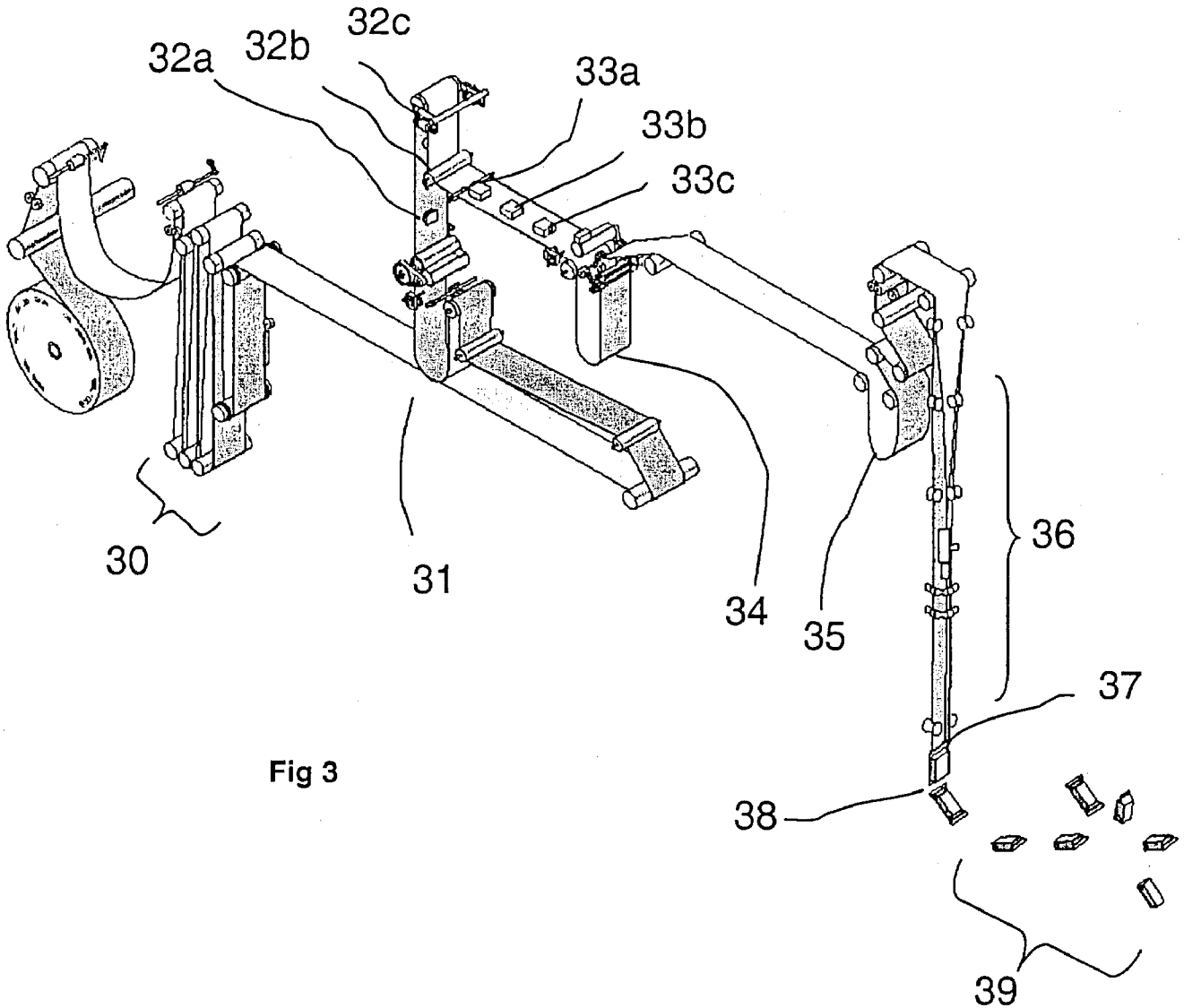
FIG. 3 shows diagrammatically an example of how a material web of packaging material can be drawn through and processed by a filling machine for producing a packaging of the type shown in FIG. 1.

According to a preferred embodiment, the opening arrangement 10 is applied to the packaging material before it has been folded to form a finished packaging. FIG. 3 shows a method of producing a packaging with an opening arrangement of the abovementioned type. For the sake of clarity, most components of the machine have been omitted and all that is shown is how the packaging material is drawn through the filling machine in connection with production of a packaging. The packaging material is supplied to the machine in the form of a roll. First, a part of the roll is drawn up to a buffer zone 30 which is used in order to take up variations in web length caused by inter alia the fact that some parts of the machine advance the web intermittently while other parts advance the web continuously. The buffer zone 30 is used in order inter alia to make automatic roll replacement possible without the machine having to be stopped. Similar buffer zones 31, 34, 35 are present in several places in the machine for similar purposes. Also present in the filling machine are three punches 32*a–c* which each punch a hole in the paper web. The paper web has a width which is adapted so that it will be folded together to form a packaging. The punches are arranged one after another in the running direction of the paper web and punch a pouring opening for a respective packaging. Along this part of the machine, the web is transported forwards intermittently between blows of the punches 32*a–c*. The method of indexing can vary between different types of machine. After one or a number of indexing(s) forward, the packaging material with the punched holes comes to an injection-moulding station. In this station, three opening arrangements 10 are injection-moulded directly on the web of packaging material. The paper web is clamped between two mould halves (one from each side of the web) which form a mould cavity between them. The mould cavity surrounds the hole punched in the packaging material, and the two halves of the mould cavity communicate with one another via the hole punched in the packaging material. In this part of the machine as well, the packaging material is fed forwards by intermittent indexing.

After the packaging material has been provided with opening arrangements 10, it is shaped into a tube by its longitudinal edges being sealed together in a conventional manner (see portion 36 in FIG. 3). The tube is filled with the product concerned and is divided into individual packagings by the tube being sealed transversely (portion 37) and cut (portion 38) into pillow-shaped packaging blanks which are finally folded into packagings by corner flaps and the like being folded and fixed in the correct position (portion 39).

This method of providing a packaging with an opening arrangement is known and will not be described further, but reference is made to, for example, U.S. Pat. No. 6,303,066 and EP-A1-1160172 for a technical description.

FIG. 4 shows the shape the opening arrangement 10 has when it has been injection-moulded or secured on the packaging material when this is in a plane or not completely folded state. Examples of situations with a not completely folded state are when the opening arrangement is applied in a system which uses blanks which are erected, sealed at one end, filled and finally sealed at the other end. A suitable opportunity for applying the opening arrangement in such a system is then after the blank has been erected so that there is space to reach the inside of the packaging as well.

The opening arrangement 10 arranged on the plane packaging material is folded so that the angle A between the lid 12 and the second portion 13*b* of the grip tab 13 is of the order of 120°. In the finished folded state (FIGS. 1 and 2), this angle is of the order of 180° (that is to say they extend in approximately the same line). On plane packaging material (FIG. 4), the angle B between the two portions 13*a–b* of the grip tab 13 is approximately 100°, and in the finished state, the angle B is approximately 90°. As mentioned above, the angle B in the finished folded state differs depending on the shape of the finished packaging. The angle B between the different portions 13*a–b* of the grip tab 13 is approximately the same as the angle of the fold 1*d* between the top surface 1*a* and the side surface 1*b*. The angle C between the first portion 13*a* of the grip tab 13 and the tamper evidence 14 is approximately 100° on plane packaging material and it is approximately 180° in the finished state, so that the first portion 13*a* of the grip tab 13 and the tamper evidence 14 extend along the same plane 16. The angle D between the tamper evidence 14 and the fastening surface 15 is approximately 90° on plane packaging material and it is approximately 180° in the finished state, so that the tamper evidence 14 and the fastening surface 15 extend along the same plane 16.

The material at the angles A and B is to be folded only through a limited angle and can moreover without problems be designed to withstand the loads which arise on account of this folding. On the other hand, the material at the angle(s) C and/or D is moreover to be easy to tear off so that a consumer can break the tamper evidence 14 easily when the packaging 1 is to be opened for the first time. As mentioned above, the configuration shown has a number of advantages compared with previously known configurations. As a consumer tears the tamper evidence 14 by applying a force to the first portion 13*a* of the grip tab 13 in a direction which extends in a transverse direction E transverse to the longitudinal direction F which is defined by the first portion 13*a* of the, grip tab 13, the tamper evidence 14 and the fastening surface 15, it is possible to design the connections of the tamper evidence 14 to the grip tab 13 and the fastening surface 15 so that they are strong in the longitudinal direction F but weak in the transverse direction E. In this way, an opening arrangement 10 has been produced which is suitable for being manufactured in the way shown in FIG. 3 but nevertheless provides the desired tamper evidence 14. As can be seen from FIGS. 1 and 2, the first portion 13*a* of the grip tab 13, the tamper evidence 14 and the fastening surface 15 extend along a common plane 16 which extends along the corner tab 1*c* of the packaging 1. In this way, there is no edge which can catch on a corner or the like on a packaging which is positioned alongside the packaging shown.

Figure 7:
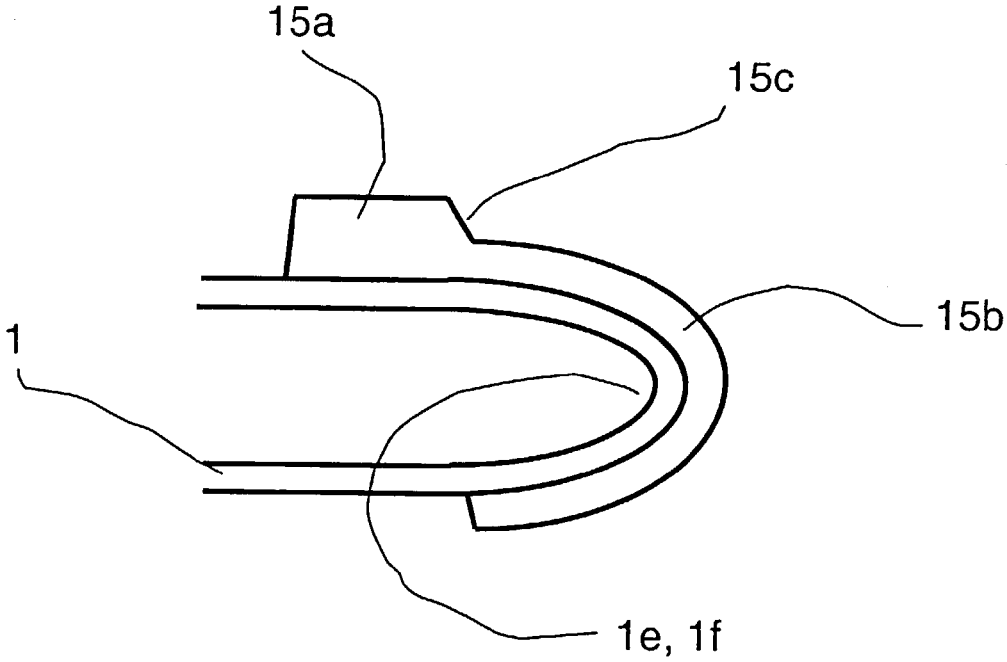
FIG. 7 shows diagrammatically how the packaging material and the fastening surface secured on the packaging material are arranged so as to be folded for formation of the packaging shown in FIG. 1.

As can be seen from FIGS. 1 and 2, the fastening surface 15 is designed and positioned on the packaging 1 in such a manner that it is folded around a corner edge 1*e* of the corner flap 1*c* when the packaging is folded from a pillow-shaped body into an essentially cuboid packaging 1. This folding-over of the fastening surface 15 around the corner edge 1*e* of the packaging 1 means that the fastening surface 15 is fixed on the packaging 1 and can take up great loads compared with if it only extended along a plane portion of the packaging 1. FIG. 7 shows diagrammatically how a fastening surface 15 is folded around a folded corner 1*e* of the packaging 1. When the fastening surface 15 is loaded by means of a force in the abovementioned longitudinal direction F during distribution of the packaging 1, the folded-in part 15*b* of the fastening surface 15 will have to be drawn around the corner 1*e* in order for the fastening surface 15 to come loose. In the same way, the fastening surface 15 will have to be drawn around the corner in order to come loose when a consumer breaks the tamper evidence 14 for the first time. One advantage of the fastening surface 15 being folded around the corner edge 1*e* of the corner flap 1*c* as shown in FIGS. 1 and 2 is that the inclination of the corner edge 1*e* means that, irrespective of the angle of the force between the transverse direction and the longitudinal direction, the folding-over 15*b* will have to be drawn around the corner 1*e* as long as the force on the fastening surface 15 is directed inwards towards the rest of the side surface 1*b*.

Figure 5:
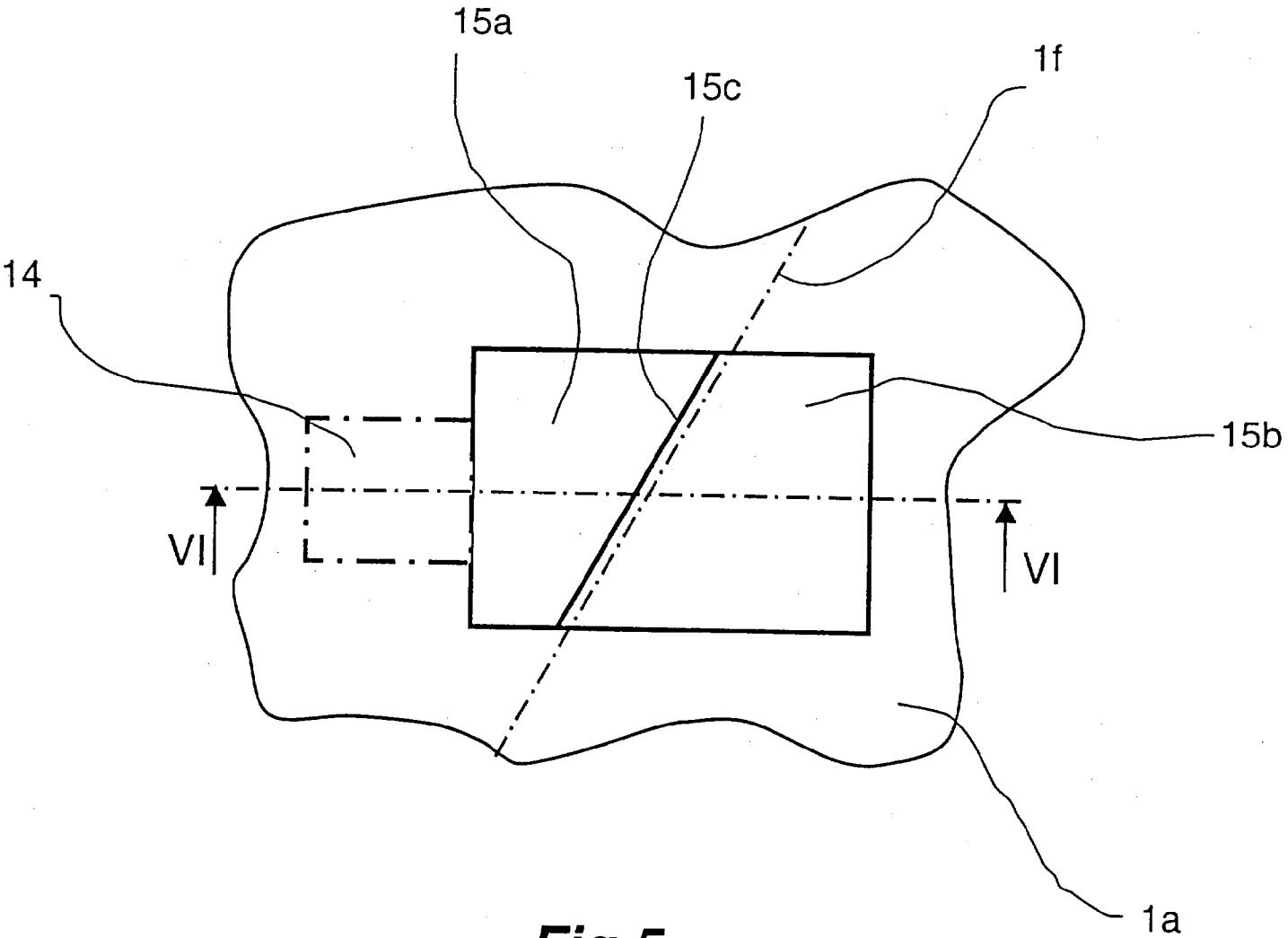
FIG. 5 shows diagrammatically the fastening surface seen from directly above.
Figure 6:
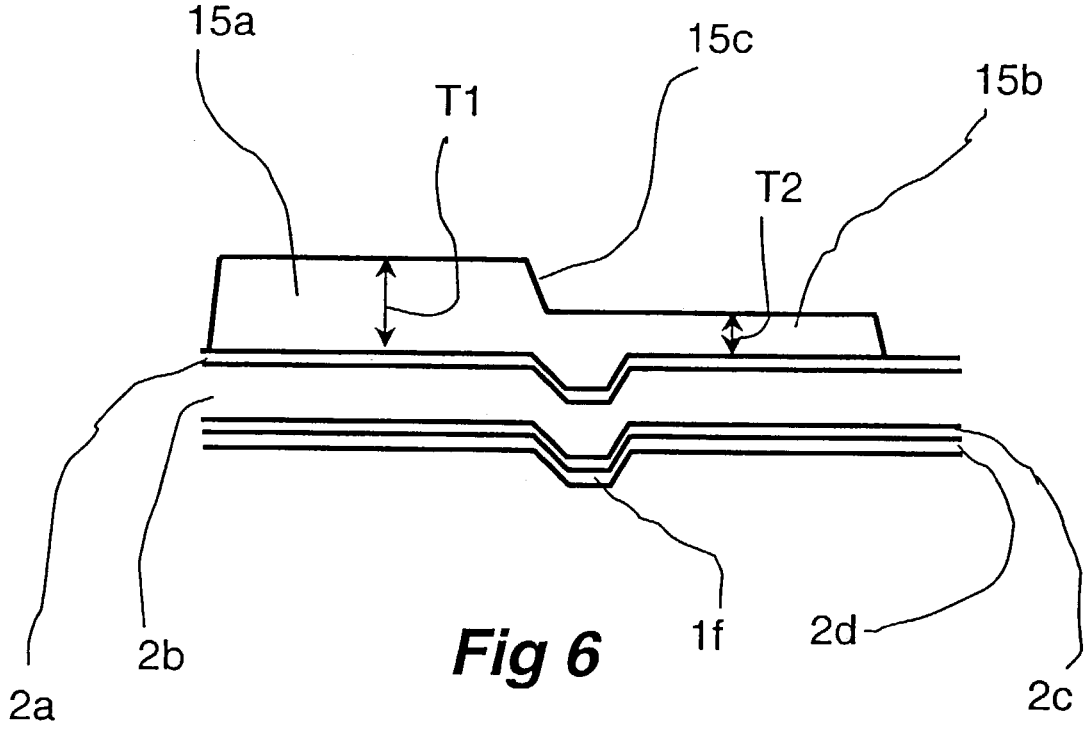
FIG. 6 shows diagrammatically the packaging material and the fastening surface secured on the packaging material seen from the side.

FIGS. 5–7 show a fastening surface 15 diagrammatically. That portion of the fastening surface 15 which is located next to the tamper evidence 14 and is not folded around the corner edge 1*e* on folding of the finished packaging has a first thickness T1 which is greater than the thickness T2 of that portion 15*b* of the fastening surface 15 which is intended to be folded around the corner edge 1*e* of the corner flap 1*c*. The transition 15*c* between the thicker portion 15*a* and the thinner portion 15*b* is located along the line if along which the corner flap 1*c* is intended to be folded 1*e*. In the configuration shown in FIGS. 5 and 6, the said line if is a crease line 1*f*.

FIG. 6 shows diagrammatically a type of packaging material which comprises an outer layer 2*a* of thermoplastic material, a paper layer 2*b*, a barrier layer of aluminium 2*c* and an inner layer 2*d* of thermoplastic material. The invention is not limited to this type of packaging material, but other materials with or without an aluminium layer, for example, may also be mentioned. Furthermore, the opening arrangement can be used for packaging material which does not comprise any paper layer at all. If the opening arrangement is manufactured by direct injection-moulding on the packaging material, however, it is advantageous if the outer layer 2*a* (and in most cases the inner layer 2*d* as well) is made from some form of thermoplastic material, the surface of which melts slightly when molten plastic is supplied during injection moulding so that the opening arrangement is welded firmly to the packaging material.

The transition 15*c* between the thicker portion 15*a* and the thinner portion 15*b* will also contribute to correct welding to the packaging material as the plastic which is injected into the mould cavity via a nozzle somewhere on the lid 12 will be heated at the narrowing 15*c* on account of the internal friction so that the thinner portion 15*b* is welded to the packaging material. According to a preferred embodiment, the thicker portion 15*a* is approximately just less than twice as thick as the thinner portion 15*b*. The thicker portion 15*a* has a thickness which lies within the range 0.2 mm to approximately 1 mm, and the thinner portion 15*b* has a thickness which lies within the range 0.1 mm to nearly 1 mm. According to a preferred embodiment, the thicker portion 15*a* has a thickness T1 of 0.5 mm, and the thinner portion 15*b* has a thickness T2 of 0.3 mm.

According to one embodiment, the opening arrangement 10 is made in one piece from injection-moulded thermoplastic material, such as polyethylene or the like. In such a configuration, it is suitable to mould the bottom piece 11 and the lid 12 in a closed state so that they are moulded into a continuous body which completely seals the abovementioned hole in the packaging material. In order for it to be possible for the consumer to open the packaging, the transition between the lid 12 and the bottom piece 11 along the greater part of the pouring opening is designed as a weakening along which a tear will run when the consumer opens the packaging for the first time. When the consumer closes the packaging after some of the product has been emptied out of the packaging, this weakening line of the lid 12 will be pressed down through the pouring opening in the bottom piece 11 so that a collar 19 above the weakening seals against the delimiting edge of the pouring opening.

FIG. 7 shows how the packaging material 1 and the fastening surface 15 are folded for formation of a corner edge 1*e*. In FIG. 7, the materials have not been folded completely, but the fold has only been started. When folding is complete, the inner sides of the packaging material lie against one another.

It is clear that many modifications of the embodiments of the invention described herein are possible within the scope of the invention, which is defined in the following patent claims.

For example, the opening arrangement can be produced separately and then secured on the packaging material on a plane web or as a fully or partly folded packaging.

Furthermore, the opening arrangement can be designed so that the bottom piece extends around the corner edge of the packaging between the top surface and the side surface and the fastening surface is secured in an extension of the bottom piece.

It must also be mentioned that the angle discussed above between the top surface and the side surface on which the fastening surface is secured concerns the angle seen along the fold line between the top surface and the side surface. It is of course also possible to envisage packagings where the side surface is inclined or has a different shape if the packaging is viewed from directly above. However, this angle or shape does not affect the tamper evidence and fastening surface according to the invention to any great extent.

It is of course possible for the method according to the invention of securing the fastening surface to be used for most types of opening arrangement. The fastening surface can be used for, for example, securing a tamper evidence seal to a screw cap or the like.

The invention claimed is:

1. An opening arrangement adapted to be secured to an existing packaging material, the opening arrangement comprising a bottom piece which is disposed to be positioned on the packaging material and to define a pouring opening, a lid which is disposed, in a closed state, to seal the pouring opening, and a tamper evidence which is intended to be broken the first time the opening arrangement is opened and which is connected to a pull tab connected to the lid and to a fastening surface which is disposed to be connected to the packaging material, wherein a first portion of the pull tab to which the tamper evidence is connected, the tamper evidence and the fastening surface extend along a common geometric plane, and the fastening surface is disposed to extend over a fold line along which the packaging material is intended to be double-folded for forming a package.

2. The opening arrangement according to claim 1, in which a portion of the fastening surface which is intended to be located on the same side of the fold line as the bottom piece has a thickness which is greater than the thickness of a portion of the fastening surface which is intended to be located on the other side of the fold line.

3. The opening arrangement according to claim 1, in which the tamper evidence is connected to the lid via the pull tab connected to the lid.

4. An opening arrangement comprising a bottom piece which is disposed to be positioned on a packaging material and to define a pouring opening, a lid which is disposed, in a closed state, to seal the pouring opening, and a tamper evidence which is intended to be broken the first time the opening arrangement is opened and which is connected to a pull tab connected to the lid and to a fastening surface which is disposed to be connected to the packaging material, wherein a first portion of the pull tab to which the tamper evidence is connected, the tamper evidence and the fastening surface extend along a common geometric plane, and the fastening surface is disposed to extend over a fold line along which the packaging material is intended to be double-folded for forming a package, the opening arrangement manufactured in one piece by injection-moulding a thermoplastic material.

5. The opening arrangement according to claim 4, in which the lid and the bottom piece are moulded in a closed state, the connection between the lid and the bottom piece around the greater part of the pouring opening comprising a weakening line which is intended to be broken the first time the opening arrangement is opened.

6. The opening arrangement according to claim 4, which is manufactured in one piece by injection-moulding a thermoplastic material directly on the packaging material.

7. A package produced by folding a packaging material which is provided with an opening arrangement separate from the packaging material, the opening arrangement comprises a bottom piece which is intended to define a pouring opening, a lid which is disposed, in a closed state, to seal the pouring opening, and a tamper evidence which is intended to be broken the first time the opening arrangement is opened and which is connected to the lid and to a fastening surface which is connected to the packaging material, wherein a first portion of the pull tab to which the tamper evidence is connected, the tamper evidence and the fastening surface extend along a common geometric plane, and the fastening surface is disposed to extend over a fold line along which the packaging material is intended to be double-folded for forming the package.

8. The package according to claim 7, in which a portion of the fastening surface which is located on the same side of the fold line as the bottom piece has a thickness which is greater than the thickness of a portion of the fastening surface which is located on the other side of the fold line.

9. The package according to claim 7, in which the fold line over which the fastening surface extends is designed as a crease line.

10. The package according to claim 7, in which the opening arrangement is manufactured in one piece by injection-moulding a thermoplastic material.

11. The package according to claim 10, in which the lid and the bottom piece are moulded in a closed state, the connection between the lid and the bottom piece around the greater part of the pouring opening comprising a weakening line which is intended to be broken the first time the opening arrangement is opened.

12. The package according to claim 10, in which the opening arrangement is manufactured in one piece by injection-moulding a thermoplastic material directly on the packaging material.

13. The package according to claim 7, in which the tamper evidence is connected to the lid via a pull tab connected to the lid.

14. The package according to claim 7, in which the packaging material is, for formation of the package, folded along a line which extends transversely to a line which is defined by the bottom piece, the tamper evidence and the fastening surface.

15. The package according to claim 7, in which the packaging material is provided with a crease line, the bottom surface and the fastening surface being secured on either side of the crease line.

* * * * *